United States Patent [19]

Matumoto

[11] Patent Number: 4,892,340

[45] Date of Patent: Jan. 9, 1990

[54] ELECTRIC LOCKING DEVICE FOR LID

[75] Inventor: Masaharu Matumoto, Yokohama, Japan

[73] Assignee: Ohi Seisakusho Co., Ltd., Yokohama, Japan

[21] Appl. No.: 106,680

[22] Filed: Oct. 13, 1987

[51] Int. Cl.[4] ..... E05B 65/19

[52] U.S. Cl. ..... 292/201; 292/341.16; 292/216; 292/DIG. 43

[58] Field of Search ..... 292/201, 341.16, DIG. 23, 292/DIG. 14, DIG. 43, DIG. 25, 216; 70/241

[56] References Cited

U.S. PATENT DOCUMENTS

| | | | |
|---|---|---|---|
| 2,896,990 | 7/1959 | Garvey et al. | 292/341.16 |
| 2,903,288 | 9/1959 | Joachim et al. | 292/341.16 |
| 2,916,319 | 12/1959 | Du Bois | 292/DIG. 43 |
| 2,994,550 | 8/1961 | White | 292/341.16 |
| 3,056,619 | 10/1962 | Fox et al. | 292/341.15 |
| 3,081,078 | 3/1963 | Lohr | 292/DIG. 43 |
| 3,378,291 | 4/1968 | Brian | 292/DIG. 43 |
| 3,403,934 | 10/1968 | Butts | 292/341.16 |
| 3,835,678 | 9/1974 | Meyer et al. | 70/241 |
| 3,985,381 | 10/1976 | Kobayashi | 292/DIG. 43 |
| 4,073,170 | 2/1978 | Miyabayashi | 292/DIG. 43 |
| 4,322,959 | 4/1982 | Mochida | 292/DIG. 43 |
| 4,456,289 | 6/1984 | Badiali | 292/DIG. 14 |
| 4,597,598 | 7/1986 | Bascov | 292/216 |
| 4,671,548 | 6/1987 | Haberle et al. | 292/DIG. 43 |
| 4,707,007 | 11/1987 | Inoh | 292/341.16 |

FOREIGN PATENT DOCUMENTS

| | | |
|---|---|---|
| 3636828A1 | 5/1987 | Fed. Rep. of Germany . |
| 58-27457 | 8/1956 | Japan . |

*Primary Examiner*—Gary L. Smith
*Assistant Examiner*—Eric K. Nicholson
*Attorney, Agent, or Firm*—Foley & Lardner, Schwartz, Jeffery, Schwaab, Mack, Blumenthal & Evans

[57] ABSTRACT

Herein disclosed is an electric locking device for locking a lid to a receptacle member, which comprises a lock proper which is mounted to the receptacle member in a manner to be movable in a given way on the receptacle member and capable of locking the striker when the latter is brought into full engagement therewith, a locked condition sensing switch mounted to the receptacle member for sensing whether the striker is locked by the lock proper or not, an electric mover mounted to the receptacle member for moving, upon energization, the lock proper in the given way, and a control circuit for controlling operation of the electric mover in accordance with operation of the locked condition sensing switch.

17 Claims, 9 Drawing Sheets

ELECTRIC LOCKING DEVICE FOR LID

BACKGROUND OF THE INVENTION

1. Field of the Invention

The present invention relates in general to a locking device for locking a lid or the like, and more particularly to an electric locking device particularly used in a motor vehicle for locking a trunk lid, a back door, and an engine hood or the like by using an electric motor.

2. Description of the Prior Art

Utility Model First Provisional Publication No. 58-27457 shows an electric lid locking device which comprises a lock proper mounted to a trunk lid and a striker mounted to a vehicle body. The striker is held by an electric striker mover which moves the striker downward upon energization thereof. When the lid is pivoted down to its half-closed position wherein the lock proper is half-latched with the striker, the striker is thereafter moved down by the striker mover pulling down the lock proper and thus the lid to a full-closed position wherein the lock proper is fully latched with the striker.

According to this locking device, the full closing of the lid is readily achieved by only pushing down the lid to the half-latched position. That is, upon half-latching of the lock proper, the same and thus the trunk lid is automatically pulled down to the full-closed position compressing a seal strip mounted on the periphery of the trunk opening. This device thus lightens the labor of a person who intends to close the trunk lid because he or she does not need to fight against the counterforce produced by the seal strip when the lid is fully closed.

However, due to its inherency in construction, the above-mentioned conventional locking device has the following drawbacks. That is, since the heavy and bulky lock proper is mounted to trunk lid, the weight of the lid is inevitably increased thereby making the opening motion of the lid dull and the bulky construction of the lock proper interrupts smooth loading and unloading of luggages into and from the trunk. Furthermore, since a lock condition sensor is mounted on the trunk lid and the electric striker mover is mounted to the trunk body side, it is necessary to employ a troublesome wiring of electrically connecting these two parts. In fact, the wire extends unsightly through a hinge member of the lid.

SUMMARY OF THE INVENTION

It is therefore an object of the present invention to provide an electric locking device for a lid, which is free of the above-mentioned drawbacks.

According to the present invention, there is provided an electric locking device for locking a lid to a receptacle member, which comprises a striker mounted to the lid; a lock proper mounted to the receptacle member and locking the striker when the striker is brought into full engagement therewith, the lock proper being movable relative to the receptacle member along a given way which is described by the striker; a locked condition sensing means mounted to the receptacle member and issuing a striker locked condition representing signal when the striker is locked by the lock proper and issuing a striker released condition representing signal when the striker is released from the lock proper; an electric mover mounted to the receptacle member for moving, when electrically energized, the lock proper along the given way; and a control circuit for controlling operation of the electric mover in such a manner that when the sensing means issues the striker locked condition representing signal, the mover moves the lock proper in one direction along the given way to a first position ready for achieving full closing of the lid and when the sensing means issues the striker released condition representing signal, the mover moves the lock proper in the other direction along the given way to a second position ready for catching the striker.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Referring to FIGS. 1 to 14, there is shown an electric locking device of a first embodiment of the present invention, which is practically applied to a motor vehicle for locking and unlocking a trunk lid.

Figure 2:
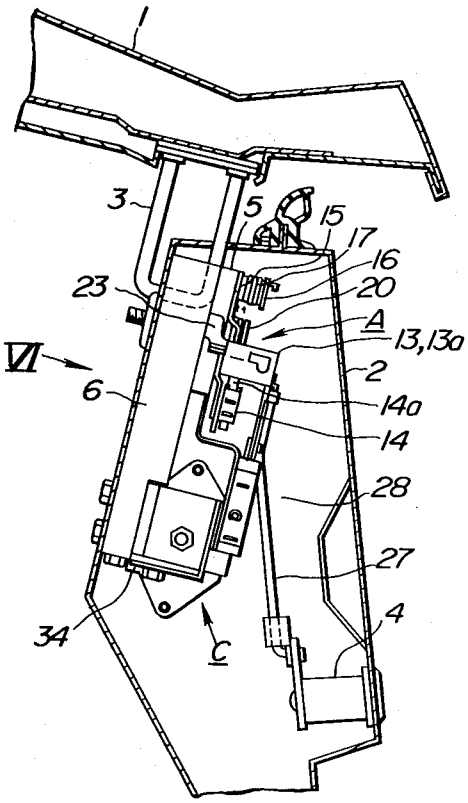
FIG. 2 is a view similar to FIG. 1, but showing a condition wherein the trunk lid is half-closed.
Figure 1:
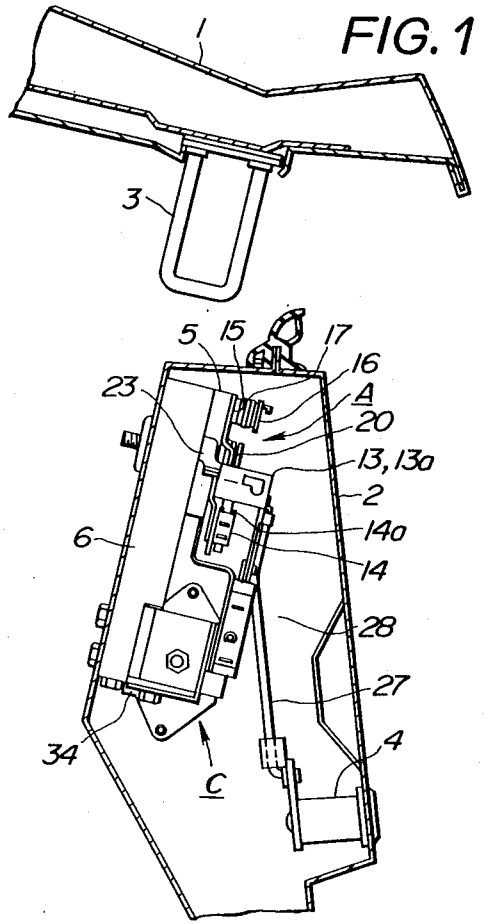
FIG. 1 is a sectional view of an electric locking device of a first embodiment of the present invention, which, is practically applied to an automotive trunk lid, showing a condition wherein the trunk lid open.
Figure 3:
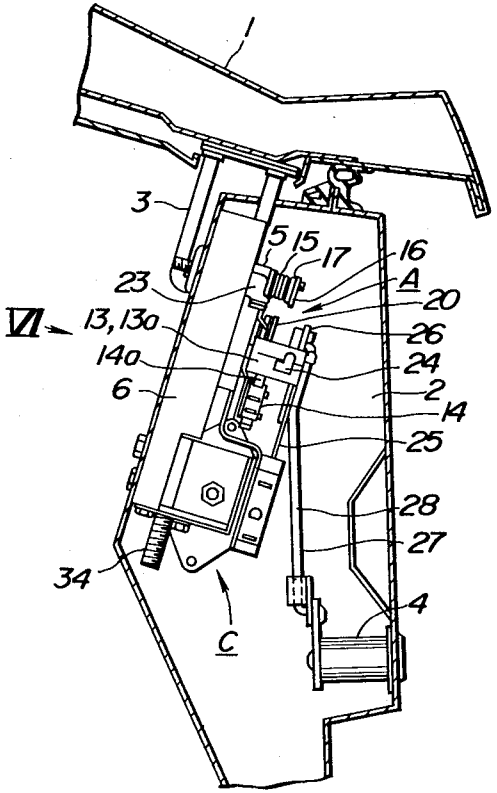
FIG. 3 is a view also similar to FIG. 1, but showing a condition wherein the trunk lid is fully closed.

In the drawings, particularly FIGS. 1 to 3, numeral 1 denotes a trunk lid of the motor vehicle, and 2 denotes a rear part of the vehicle body by which a trunk room is defined. Although not shown in the drawings, a front part (viz., left part as viewed in the drawings) of the trunk lid 1 is pivotally connected through known hinges to a front part of the periphery of the trunk opening.

The trunk lid 1 is provided at its rear center portion with a generally U-shaped striker 3 which projects downward.

The rear part 2 of the vehicle body is equipped with a guide frame 6 having a channel like construction, which extends in an upward and downward direction. The guide frame 6 slidably receives therein a hollow slider 5 constructed of a plastics. The slider 5 is sandwiched between two metal plates (no numerals).

Figure 4:
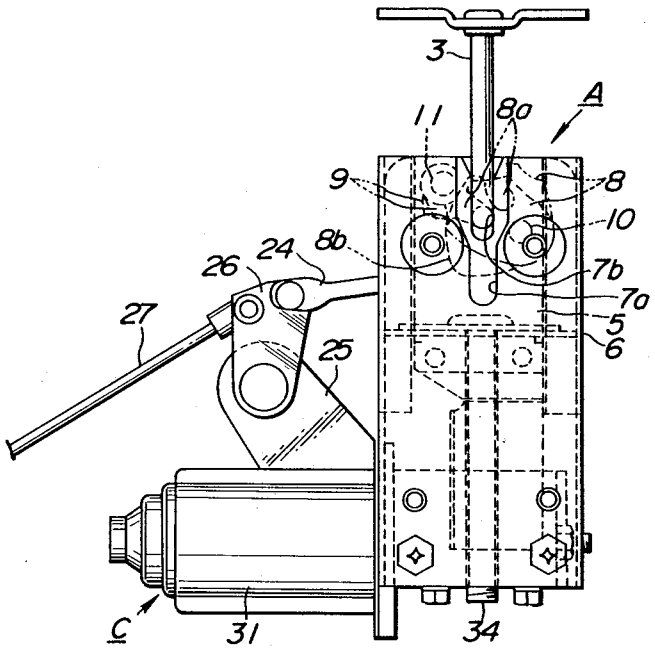
FIG. 4 is a front view of the electric locking device, taken from the direction of the arrow "IV" of FIG. 2.

As is seen from FIG. 4, the guide frame 6 and the slider 5 are formed at their upper portions with respective longitudinally extending cuts 7*a* and 7*b*.

Figure 6:
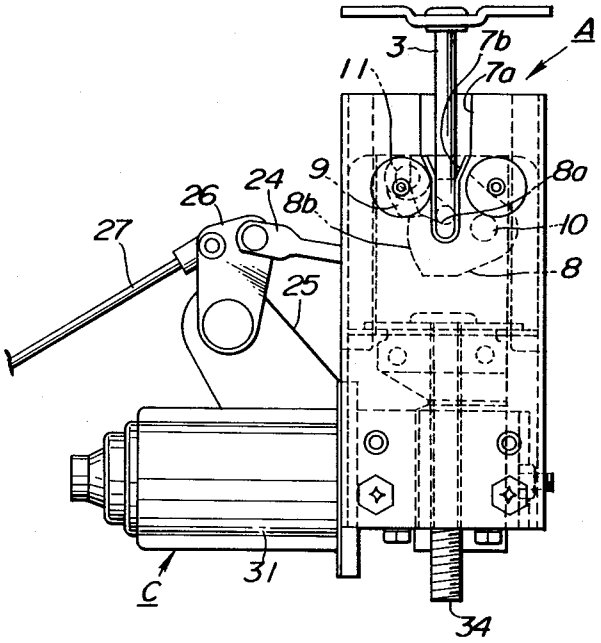
FIG. 6 is a front view of the electric locking device, taken from the direction of the arrow "VI" of FIG. 3.
Figure 12:
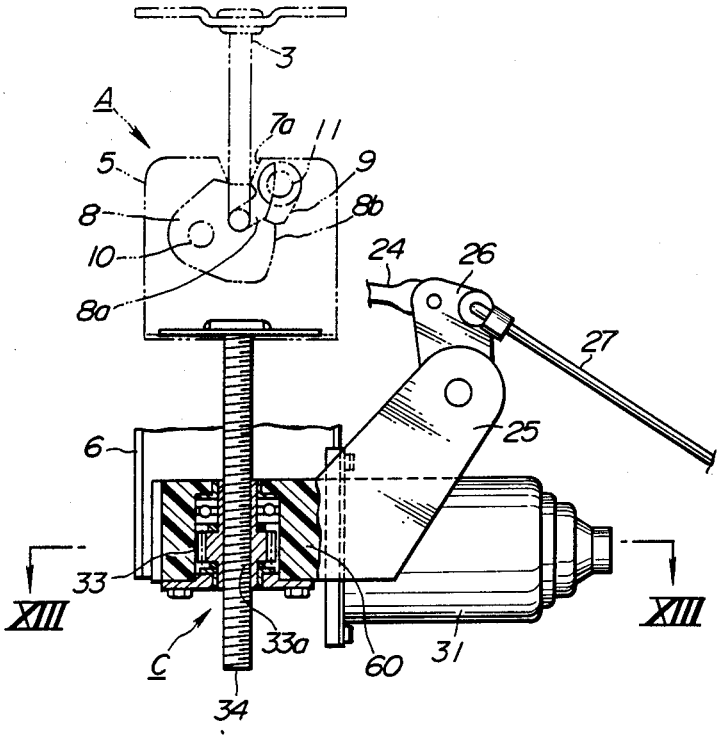
FIG. 12 is a partially broken back view of the electric locking device with some parts removed for clarification of the arrangement.

As is understood from FIGS. 4, 6 and 12, within the hollow slider 5, there are operatively arranged a latch plate 8 and a pawl plate 9. The latch plate 8 is rotatably held by a shaft 10 passing across the hollow of the slider 5 and secured to the same, while the pawl plate 9 is integrally formed with a shaft 11 which passes through the hollow and is rotatably held by the slider 5. Each shaft 10 or 11 extends perpendicular to a major flat front wall (viz., the left side wall as viewed in FIG. 1) of the guide frame 6. As will become apparent as the description proceeds, the pawl plate 9 functions to restrict rotation of the latch plate 8.

A spring (not shown) is disposed about the shaft 10 to bias the latch plate 8 in a clockwise direction in FIG. 4 about the shaft 10. As shown in this drawing, under a rest condition, the latch plate 8 assumes a striker releasing position as illustrated by a phantom line, while, when the striker 3 of the trunk lid 1 is lowered and brought into engagement with a catching recess 8*a* of the latch plate 8, the latter can be turned in a counterclockwise direction, against the force of the biasing spring, to a fully engaging position as illustrated by a broken line.

Figure 5:
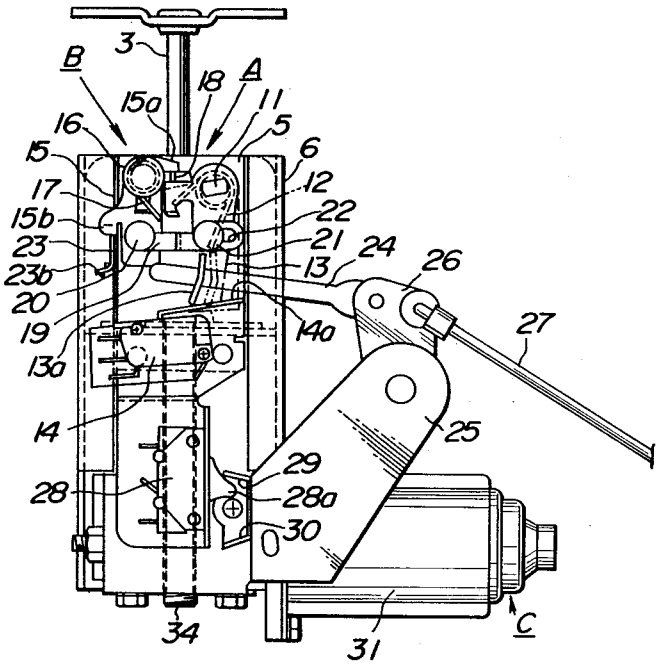
FIG. 5 is a back view of the electric locking device shown in FIG. 4.

As is seen from FIG. 5, a spring 12 is disposed about an outwardly projected part (viz., the part projected toward this side in FIG. 5) of the shaft 11 to bias the pawl plate 9 in a clockwise direction in this drawing (that is, in a counterclockwise direction in FIG. 4). As is seen from FIG. 4, when the latch plate 8 assumes the striker releasing position as illustrated by the phantom line, the pawl plate 9 assumes a lock releasing position as illustrated by a phantom line wherein a leading end of the pawl plate 9 abuts on an arcuate peripheral portion 8*b* of the latch plate 8. The arcuate peripheral portion is shaped concentric with the shaft 10. When now the latch plate 8 is turned to the fully engaging position as illustrated by the broken line in FIG. 4, the pawl plate 9 is turned to a lock establishing position as illustrated by the broken line causing the leading end thereof to drop into the engaging recess 8*a* of the latch plate 8, so that thereafter, a counterwise returning rotation of the latch plate 8 is suppressed by the pawl plate 9.

As is shown in FIG. 5, the outwardly projected part of the shaft 11 is equipped with an open lever 13 which extends downwardly. Thus, the open lever 3, the shaft 11 and the pawl plate 9 can rotate as a unit about the shaft 11. When the pawl plate 9 assumes the lock releasing position, the open lever 13 assumes its lock releasing position as illustrated in a phantom line in FIG. 5, and when the pawl plate 9 assumes the lock establishing position, the open lever 13 assumes its lock establishing position as illustrated by a solid line in the drawing.

Accordingly, when, with the striker 3 fully engaged with the latch plate 8, the open lever 13 is turned in a counterclockwise direction in FIG. 5 from its lock establishing position to its lock releasing position, the pawl plate 9 is turned to release the latch plate 8 thereby permitting the striker 3 to be released from the latch plate 8.

Thus, it will be appreciated that the slider 5, the latch plate 8, the pawl plate 9 and the open lever 13 constitute a lock proper (A) which is mounted to the rear part 2 of the vehicle body.

As is best seen in FIG. 1, the open lever 13 is formed with a rearwardly bent lower portion 13*a*. A step like bracket (no numeral) is fixed to a lower portion of the slider 5 and extends downward to such an extent to cover an after-mentioned supporting block 60 (see FIGS. 12 and 13) secured to the guide frame 6. A locked condition sensor or switch 14 is mounted on an upper portion of the step like bracket, which has an actuator arm 14*a* to which a lower edge of the lower portion 13*a* of the open lever 13 contacts. It is to be noted that ON and OFF conditions of the switch 14 are selectively effected in response to the pivotal movement of the open lever 13, that is, when the open lever 13 is pivoted from its lock establishing position to its lock releasing position and vice versa.

The function of the locked condition sensor 14 will be described in detail hereinafter.

The slider 5 is further provided near the open lever 13 with a lock cancelling lever 15. The lock cancelling lever 15 has an upper portion pivotally held by a stud pin 16 secured to the slider 5. More specifically, the upper portion of the lever 15 has an opening (no numeral) through which the stud pin 16 passes. The stud pin 16 has an effective shank portion longer than the thickness of the lock cancelling lever 15, so that the lever 15 is able to not only rotate about the stud pin 16 but also slide along the shank portion of the same. In other words, the lever 15 dangles freely from the stud pin 16.

A coil spring 17 is disposed about the stud pin 16 between an enlarged head of the pin 16 and the lock cancelling lever 15 having one end hooked to the head and the other end hooked to the lever 15, so that the lever 15 is biased not only to rotate in a clockwise direction in FIG. 5 and but also to abut on the outer surface of the slider 5.

As is seen from FIG. 5, the lock cancelling lever 15 is formed at its upper portion with a lug 15*a* which projects toward the upper portion of the open lever 13. Engageable with the lug 15*a* is a stopper 18 which is formed on the slider 5. Usually, due to the biasing force of the spring 17, the lug 15*a* abuts on the stopper 18 suppressing excessive clockwise rotation of the lock cancelling lever 15. As will be described hereinafter, the stopper can stop an excessive clockwise rotation of the open lever 13.

Figure 7:
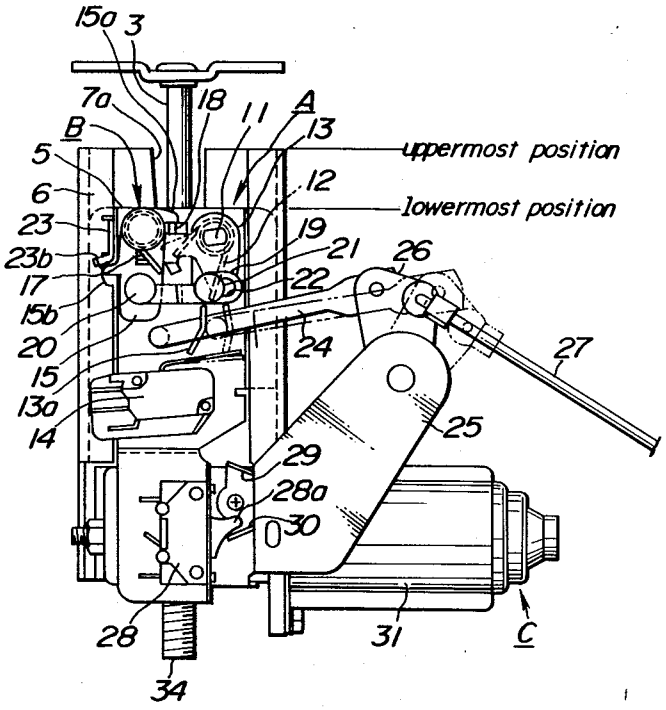
FIG. 7 is a back view of the electric locking device shown in FIG. 3.
Figure 10:
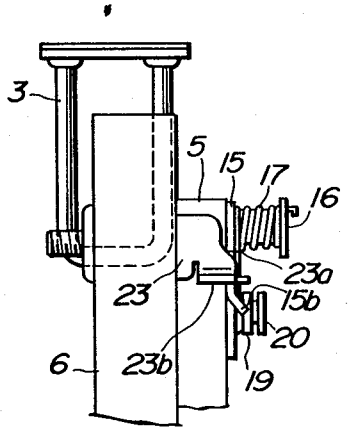
FIG. 10 is a view also similar to FIG. 8, but showing a condition wherein the striker on the trunk lid is further lowered from the position of FIG. 9.
Figure 9:
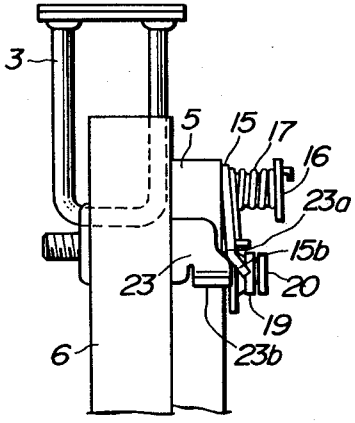
FIG. 9 is a view similar to FIG. 8, but showing a condition wherein a striker on the trunk lid is somewhat lowered from the position of FIG. 8.
Figure 8:
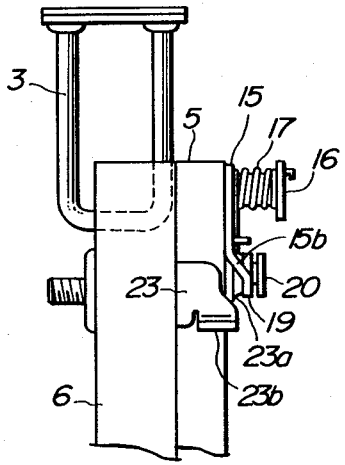
FIG. 8 is an enlarged side view of essential parts of the electric locking device, showing the condition wherein the trunk lid is half-closed.

As is seen from FIG. 5, the lock cancelling lever 15 is provided at its lower portion with a stud pin 20 to which a connecting lever 19 is pivotally connected at its left end. A right portion of the connecting lever 19 is formed with a longitudinally extending slot 22 through which a pin 21 fixed to a middle portion of the open lever 13 passes. The pin 21 has an enlarged head to prevent disconnection of the connecting lever 19 from the pin 21. The lock cancelling lever 15 is formed at its intermediate left edge with a projection 15*b* the lower end of which is bent toward this side in FIG. 5. As will be described hereinafter, when, by means of an aftermentioned driving device (C), the slider 5 is moved from its uppermost position as shown in FIGS. 4 and 5 toward its lower its lowermost position as shown in FIGS. 6 and 7, the projection 15*b* of the lever 15 rides over a raised edge 23*a* formed on a guide piece 23 fixed to a rear left portion of the guide frame 6. The shape of the raised edge 23*a* may be well understood from FIG. 8. FIG. 9 shows the condition wherein the projection 15*b* rides on the raised edge 23*a*. Thus, in the downward movement of the slider 5, the projection 15*b* rides on the raised edge 23*a* causing the lock cancelling lever 15 to pivot toward this side in FIG. 5 about the stud pin 16, and when the projection 15*b* gets over the raised edge 23*a* as shown in FIG. 10, the lock cancelling lever 15 is pivoted toward the other side to assume its original position. During this movement of the slider 5, the lug 15*a* of the lever 15 is kept in contact with the stopper 18.

Figure 11:
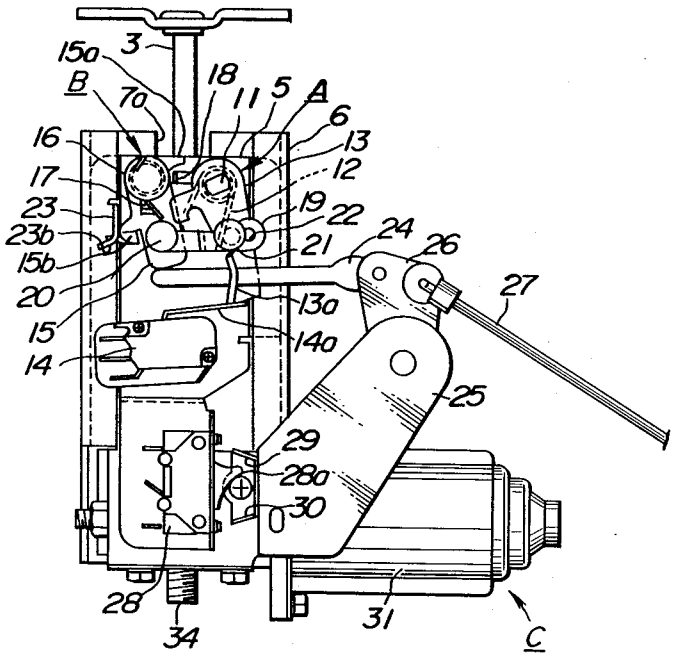
FIG. 11 is a view similar to FIG. 7, but showing a condition wherein a lock proper is under upward movement.

On the contrary, in an upward movement of the slider 5 from its lowermost position to its uppermost position, the upper edge of the projection 15*b* of the lock cancelling lever 15 comes to contact with an inclined surface 23*b* formed on the raised edge 23*a* and slides along the surface 23*b* causing the lock cancelling lever 15 to pivot rightward in FIG. 11. With this rightward movement of the lever 15, the connecting lever 19 pushes the open lever 13 rightward causing the latter to be turned to its lock cancelling position thereby causing the lock proper (A) to assume its lock cancelling condition. When the projection 15*b* of the lever 15 thereafter gets over the raised edge 23*a*, the lock cancelling lever 15 is returned to its original rest position by the function of the spring 17

Thus, it will be appreciated that the lock cancelling lever 15, the connecting lever 19 and the guide piece 23 constitute a lock cancelling mechanism (B).

As is seen from FIG. 5, a rod 24 passes through an opening (no numeral) formed in the lower bent portion 13*a* of the open lever 13, and a leading end or left end of the rod 24 is bent toward the other side in the drawing to form a hook. Thus, when the rod 24 is moved rightward by a certain distance, the bent end of the rod 24 comes to engagement with bent portion 13*a* of the open lever 13 and pushes the same rightward. The right end of the rod 24 is pivotally connected to a pivotal arm 26 which is pivotally held by a bracket 25. The bracket 25 is bolted to a supporting bracket (not shown) which is secured to the guide frame 6. An elongate rod 27 extends from the pivotal arm 26 to a key cylinder device 4 (see FIGS. 1 to 3) mounted to the rear part 2 of the vehicle body. When, due to manipulation of a key plate (not shown), the key cylinder is rotated in a given direction, the rod 27 is pulled toward the key cylinder thereby to turn the open lever 13 to its lock releasing position.

As seen from FIG. 5, a known switch 28 is mounted to the lower portion of the afore-mentioned step like bracket secured to the slider 5.

The switch 28 has an actuating lever 28*a* which faces toward the root of the bracket 25 and pivots in a snap action manner. The root of the bracket 25 is formed with two spaced stoppers 29 and 30 between which the actuating lever 28*a* is positioned. Preferably, each stopper 29 or 30 is equipped with a rubber cover. As is understood from FIG. 14, the switch 28 is provided with movable contacts 28*b* and 28*c* which move in synchronism with the actuating lever 28*a*. When the slider 5 comes to its uppermost position, the actuating lever 28*a* is brought into contact with the upper stopper 29 causing the movable contacts 28*b* and 28*c* to pivot from lower stationary contacts (b) to upper stationary contacts (a), while, when the slider 5 comes to its lowermost position, the actuating lever 28*a* is brought into contact with the lower stopper 30 causing the movable contacts 28*b* and 28*c* to pivot from the upper stationary contacts (a) to the lower stationary contacts (b).

Figure 13:
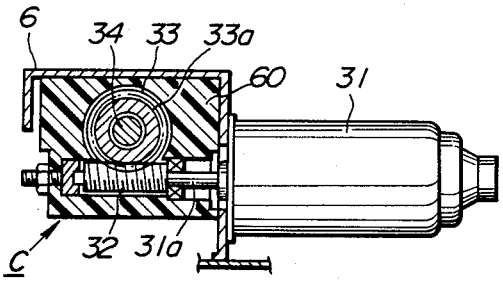
FIG. 13 is a sectional view taken along the line XIII—XIII of FIG. 12.

As is seen from FIGS. 12 and 13, a driving device (C) is mounted to a lower portion of the guide frame 6, which comprises a reversible electric motor 31 tightly fixed to the afore-mentioned supporting block 60. A worm 32 is integrally formed on an output shaft 31*a* of the motor 31 and spacedly received in the supporting block 60. A worm wheel 33 is spacedly received in the supporting block 60 and operatively engaged with the worm 32. The worm wheel 33 is formed with a concentric bore which has an internal thread 33*a*. Operatively engaged with the threaded bore (33*a*) of the worm wheel 33 is a threaded bolt 34 which extends along the axis of the guide frame 6 and has an upper end secured to the slider 5.

Thus, when the motor 31 is energized to rotate the output shaft 31*a* thereof in a given direction, the worm wheel 33 (see FIG. 13) is rotated in a counterclockwise direction in FIG. 13, so that due to the meshed engagement between the worm wheel 33 and the threaded bolt 34, the threaded bolt 34 is lowered. With this, the slider 5 can be lowered from its uppermost position to its lowermost position. When, on the contrary, the motor 31 is energized to rotate the output shaft 31*a* in a reversed direction, the bolt 34 is moved upward allowing the slider 5 to move from its lowermost position to its uppermost position.

It is to be noted that when, with the striker 3 being fully engaged with the lock proper (A), the slider 5 assumes its lowermost position, the trunk lid 1 assumes its full-closed position wherein the trunk opening is fully closed by the lid 1.

Figure 14:
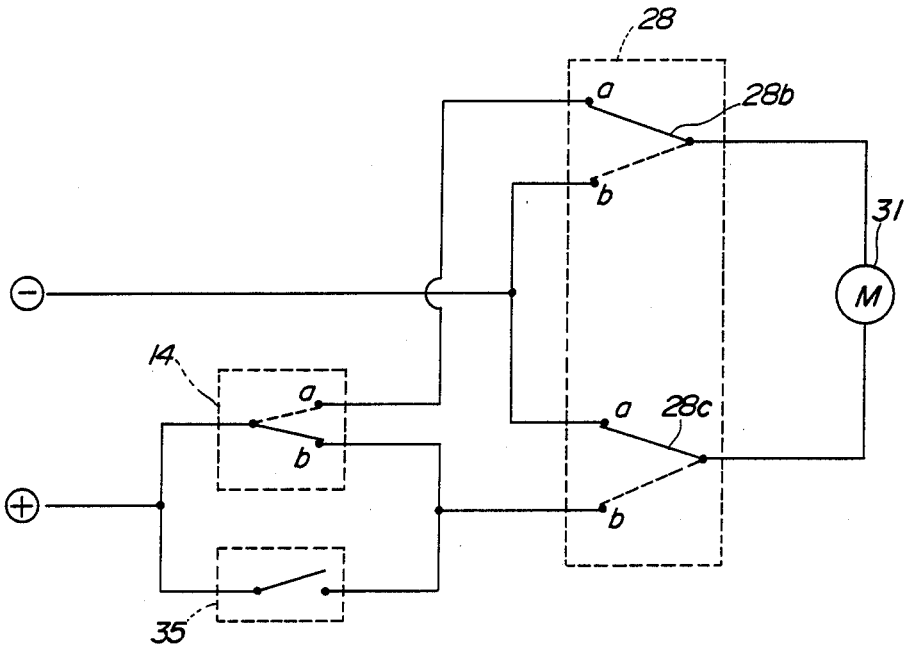
FIG. 14 is a control circuit employed in the electric locking device.

FIG. 14 shows a control circuit employed in the first embodiment as described hereinabove. Denoted by numeral 35 in this drawing is an operation switch which is placed near a driver's seat, which is, for example, of a push button. As is shown in this drawing, a line from a positive terminal of a battery (not shown) is connected to both movable contacts of the locked condition sensing switch 14 and the operation switch 35. The switch 14 has two stationary contacts (a) and (b) one of which, viz., the contact (b), is connected to a stationary contact of the switch 35 and to the stationary contact (b) for the movable contact (28*c*) of the switch 28. The other stationary contact (a) is connected to the stationary contact (a) for the movable contact 28*b* of the switch 28. Another line from a negative terminal of the battery is connected to the stationary contacts (b) and (a) for the movable contacts 28*b* and 28*c* of the switch 28. The electric motor 31 of the driving device (c) is interposed between the movable contacts 28*b* and 28*c* of the switch 28.

In the following, operation of the electric locking device of the first embodiment will be described with reference to the drawings including the circuit of FIG. 14. For facilitation of the description, it will be commenced with respect to the condition as illustrated in FIG. 1 wherein the lock proper (A) assumes its rest condition.

When, as is shown in FIG. 1, the trunk lid 1 is opened to such a degree as to completely disengage the striker 3 from the lock proper (A), the control circuit assumes a condition as illustrated by solid lines. Under this condition, the lock proper (A) assumes its lock cancelling condition causing the open lever 13 to assume its lock releasing position and thus causing the switch 14 to connect the movable contact with the stationary contact (b). Furthermore, under this condition, the slider 5 is placed at its uppermost position causing the movable contacts 28*b* and 28*c* of the switch 28 to connect with the stationary contacts (a) and (a). Of course, the operation switch 35 is kept open. Accordingly, the motor 31 is kept deenergized.

When now the trunk lid 1 is lowered to its half-closed position as shown in FIGS. 2, 4, 5 and 8, the striker 3 enters the cut 7*b* (see FIG. 4) of the slider 5 and the catching recess 8*a* of the latch plate 8. When the lid 1 is further lowered, the striker 3 is brought into full engagement with the latch plate 8.

With this movement, the pawl plate 9 and the open lever 13 are rotated to their lock establishing positions due to the force of the spring 12, so that due to the movement of the open lever 13, the locked condition sensing switch 14 moves the movable contact from the stationary contact (b) to the other stationary contact (a) as illustrated by a broken line in FIG. 14.

With this movement, a so-called "slider lowering circuit" is established which comprises the positive terminal of the battery, the stationary contact (a) of the locked condition sensing switch 14, the stationary contact (a) and the movable contact 28*b* of the switch 28, the motor 31, the movable contact 28*c* and the stationary contact (a) of the switch 28 and the negative terminal of the battery. Thus, the motor 31 is energized to rotate the output shaft 31*a* in a normal direction causing the slider 5 to move from the uppermost position toward the lowermost position.

When the slider 5 comes to the lowermost position having the trunk lid 1 settled in the full-closed position, the actuating lever 28*a* of the switch 28 is pushed upward by the lower stopper 30, so that the movable contacts 28*b* and 28*c* of the same are shifted to the other stationary contacts (b) and (b) as is illustrated by broken lines in FIG. 14. Because the stationary contact (a) for the movable contact 28*b* is disengaged from the movable contact 28*b*, the slider lowering circuit is opened thereby stopping operation of the motor 31. Under this condition, the trunk lid 1 is fully closed and locked.

When thereafter the operation switch 35 is manually closed by a person in the vehicle cabin, a so-called "slider elevating circuit" is established which comprises the positive terminal of the battery, the closed operation switch 35, the stationary contact (b) and the movable contact 28*c* of the switch 28, the motor 31, the movable contact 28*b* and the stationary contact (b) of the switch 28 and the negative terminal of the battery. Thus, the motor 31 is energized to rotate the output shaft 31*a* in the reversed direction causing the slider 5 to move from the lowermost position toward the uppermost position.

During this upward movement of the slider 5, the locked condition of the lock proper (A) is cancelled by the function of the lock cancelling mechanism (B) as has been described hereinabove. Thus, the latch plate 8 is turned by the associated spring (not shown) to the striker releasing position releasing the striker 3 from the lock proper (A).

During this movement, the open lever 13 is pivoted from its lock establishing position to the lock releasing position, so that the locked condition sensing switch 14 moves the movable contact from the stationary contact (a) to the other stationary contact (b). With this, a so-called "slider elevation assuring circuit" is established which comprises the positive terminal of the battery, the movable contact and the stationary contact (b) of the locked condition sensing switch 14, the stationary contact (b) and the movable contact 28*c* of the switch 28, the motor 31, the movable contact 28*b* and the stationary contact (b) of the switch 28 and the negative terminal of the battery. Thus, even when, during the upward movement of the slider 5, the operation switch 35 is opened breaking the "slider elevating circuit", the lock proper (A) does not stop its upward movement.

When the slider 5 comes to its uppermost position, the actuating lever 28*a* of the switch 28 is pushed downward by the upper stopper 29 so that the movable contacts 28*b* and 28*c* of the same are shifted to the stationary contacts (a) and (a). Thus, the above-mentioned two elevation circuits are opened thereby stopping the motor 31. Thus, the control circuit returns to its rest condition shown by the solid lines in FIG. 14, and the lock proper (A) returns to its rest condition shown in FIG. 1.

In addition to the above-mentioned electrically controlled operation, the following manual operation is available in the invention.

That is, when, with the trunk lid 1 being fully closed as shown in FIG. 3, the key cylinder 4 is rotated in a given direction by a key plate (not shown) manipulated by a person from the outside of the vehicle body, the rods 27 and 24 are pulled toward the key cylinder 4 turning the open lever 13 to its lock releasing position. With this, the locked condition of the lock proper (A) is cancelled causing the striker 3 of the lid 1 to disengage from the lock proper (A), so that the trunk lid 1 is opened. Because of the reasons which have been mentioned hereinabove, turning the open lever 13 to its lock releasing position causes the movable contact of the locked condition sensing switch to be shifted to the stationary contact (b).

Thus, under this condition, the above-mentioned "slider elevation assuring circuit" is established causing the motor 31 to rotate the output shaft 31*a* in a reversed direction moving the slider 5 upward.

During this upward movement of the slider 5, the lock cancelling lever 15 and the connecting lever 19 are moved toward the open lever 13. However, since the open lever 13 has been kept in its lock releasing position, the "slider elevation assuring circuit" is maintained continuing the upward movement of the slider 5.

When the slider 5 comes to its uppermost position, the actuating lever 28*a* of the switch 28 is pushed down by the upper stopper 29 so that the movable contacts 28*b* and 28*c* of the same are shifted to the respective stationary contacts (a) and (a), similar to the case which has been described hereinafore. Thus, the "slider elevation assuring circuit" becomes opened thereby stopping the motor 31 and thus stopping the slider 5 at its uppermost position.

If desired, the above-mentioned lock cancelling mechanism (B) may be replaced with the following modifications (X) and (Y).

Figure 16:
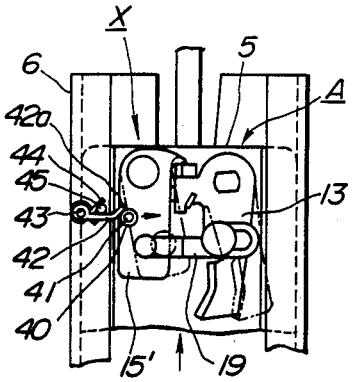
FIG. 16 is a back view, but partially, of an electric locking device of a second embodiment of the invention, showing a condition wherein a lock proper is under upward movement.
Figure 17:
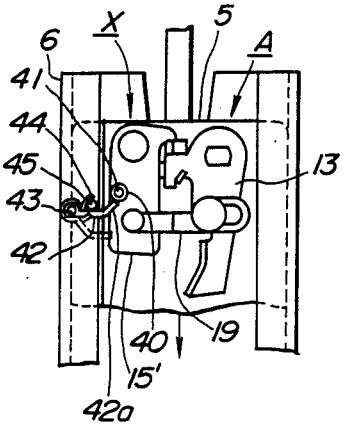
FIG. 17 is a view similar to FIG. 16, but showing a condition wherein the lock proper is under downward movement.

Referring to FIGS. 16 and 17, there is shown the first modification (X) of the lock cancelling mechanism. The modification (X) comprises a lock cancelling lever 15' pivotally connected to the slider in the same manner as the afore-mentioned lever 15. A roller 40 is rotatably connected through a pin 41 to the lever 15'. An arm 42 having a slanted leading end **42*a* is pivotally connected at its base portion to the rear left portion of the guide frame 6. A coil spring 44 is disposed about the pin 41 to bias the arm 42 in a counterclockwise direction in FIG. 16**.

Usually, the arm 42 is biased to abut on a stopper pin 45 secured to the guide frame 6, so that when, as is seen from FIG. 16, the lock proper (A) moves upward, the roller 40 is brought into contact with the slanted leading end **42*a* of the arm 42 causing the lock cancelling lever 15' to swing rightward. This movement of the lever 15' moves the connecting lever 19 rightward and thus, the open lever 13 is turned to its lock releasing position. On the contrary, when, as is shown in FIG. 17, the lock proper (A) is moved downward, the roller 40 comes to contact with the top of the slanged end 42*a* of the arm 42 and turns the arm 42 clockwisely against the force of the spring 44**. Thus, the lock proper (A) can be lowered to its lowermost position.

In this first modification (X), the lock cancelling lever 15', the roller 40, the arm 42 and the connecting lever 19 constitute a lock cancelling mechanism (B).

Figure 18:
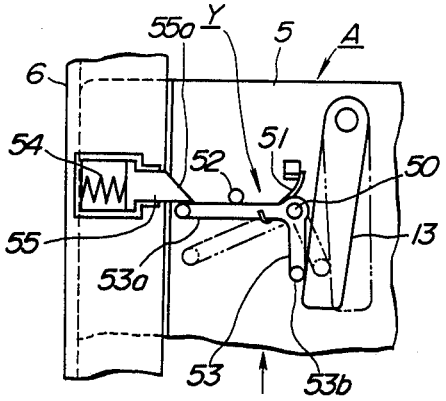
FIG. 18 is a back view, but partially, of an electric locking device of a third embodiment of the invention, showing a condition wherein a lock proper is under upward movement.
Figure 19:
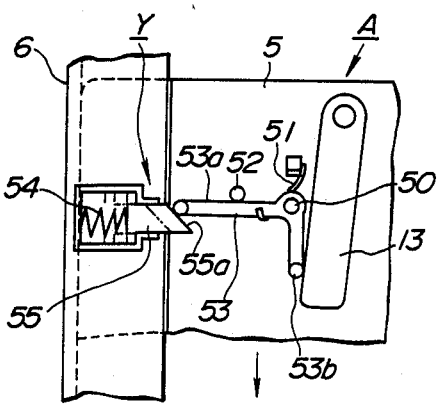
FIG. 19 is a view similar to FIG. 18, but showing a condition wherein the lock proper is under downward movement.

Referring to FIGS. 18 and 19, there is shown the second modification (Y) of the lock cancelling mechanism (B). In this modification (Y), a lock cancelling lever 53 of generally L-shaped structure is pivotally connected through a pin 50 to the slider 5. A spring 51 is associated with the lever 53 to bias the same in a clockwise direction, so that usually one arm section **53*a* of the lever 53 is biased to abut on a stopper pin 52 fixed to the slider 5. When the lever 53 is rotated in a counterclockwise direction about the pin 50, the other arm section 53*b* of the lever 53 pushes the open lever 13 to its lock releasing position. A retractable member 55 having a slanted surface 55*a* is slidably held by a frame (no numeral) secured to the rear left portion of the guide frame 6. A spring 54 is compressed between the retractable member 55 and the base of the frame thereby to bias the retractable member 55 to project rightward in FIG. 18 to such a degree as to permit the slanted surface 55*a* intersects with an imaginary circular path described by the leading end of the arm section 53*a* of the lock cancelling lever 53**.

As is shown in FIG. 18, when the lock proper (A) is moved upward, the arm section **53*a* of the lever 53 comes to engagement with the lower side of the retractable member 55 causing the lever 53 to turn in a counterclockwise direction in the drawing. This turning of the lever 53 pushes the open lever 13 to its lock releasing position as is illustrated by a phantom line in the drawing. On the contrary, when the lock proper (A) is moved downward, the leading end of the arm section 53*a* of the lever 53 comes to contact with the slanted surface 55*a* of the retractable member 55 causing the latter to move leftward against the force of the spring 54**. Thus, the lock proper (A) can be lowered to its lowermost position.

Figure 15:
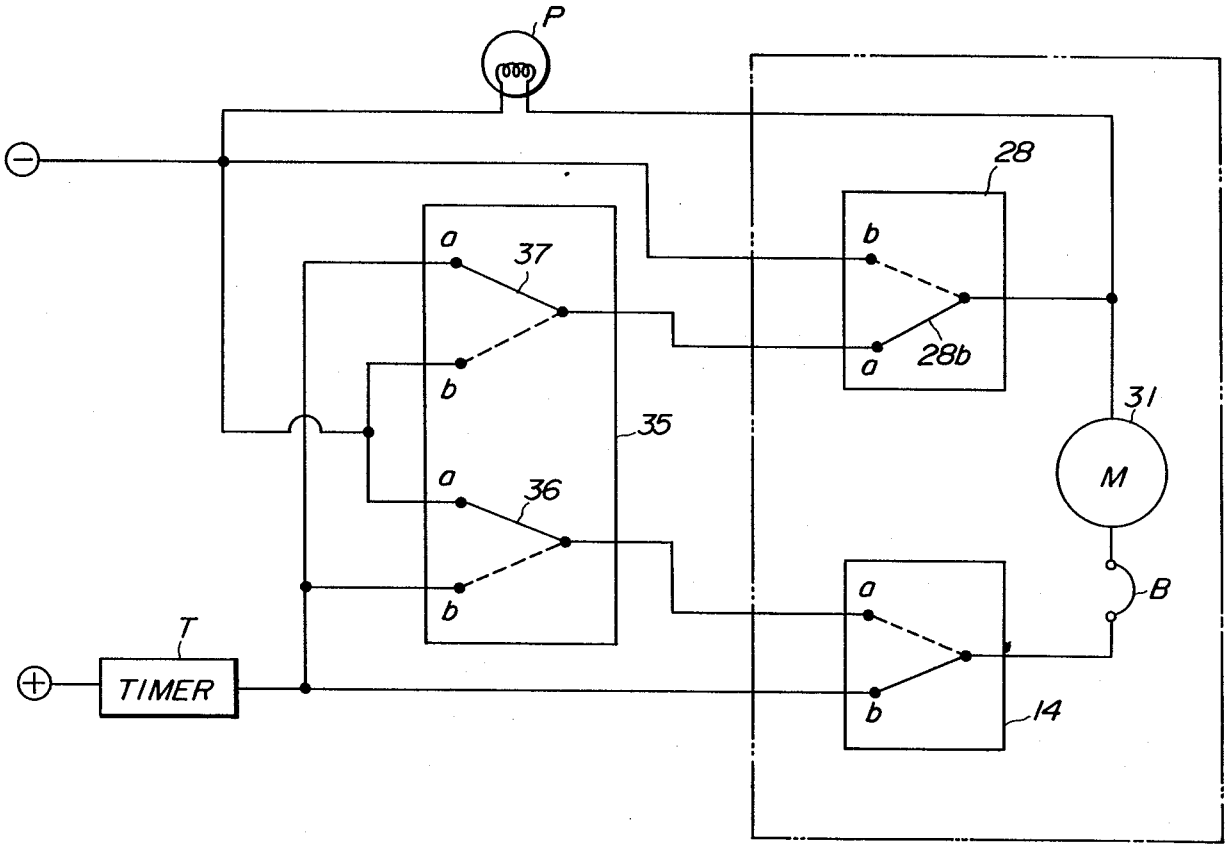
FIG. 15 is another control circuit employable in the electric locking device of the invention.

Referring to FIG. 15, there is shown a control circuit which is also employable in the present invention. This circuit is advantageous in a case wherein the lock proper (A) stops its downward movement during the final stage closing operation of the trunk lid 1 because, for example, a foreign thing gets in the way of the lid 1. Of course, in this case, the trunk lid 1 can be released from the lock proper (A) by manipulating the key cylinder 4 with a key. However, since the lock proper (A) has been already lowered to a middle part of its way, subsequent work for closing and latching the trunk lid 1 to the trunk requires a person a great deal of labor because he or she must handle the counterforce produced by a seal strip arranged on the trunk opening periphery. The circuit of FIG. 15 solves such drawbacks.

For ease of understanding, the description on the circuit will be made with respect to a case wherein the circuit is practically applied to the electric locking device including the lock cancelling mechanism (B), that is, the device as illustrated in FIGS. 1 to 13. The circuit comprises generally a locked condition sensor or switch 14, a switch 28 corresponding to the above-mentioned switch 28, and an operation switch 35 which are connected in a manner as shown in FIG. 15. It is to be noted that the switch 28 and the switch 35 are replaced with each other with respect to the afore-mentioned control circuit of FIG. 14. Designated by references "B", "P" and "T" are breaker, pilot lamp and timer respectively.

In the following, operation of the electric locking device including the control circuit of FIG. 15 will be described with reference to FIGS. 1 to 13.

When, as is shown in FIG. 1, the trunk lid 1 is opened to such a degree as to completely disengage the striker 3 from the lock proper (A), the control circuit assumes a condition as illustrated by solid lines. Under this condition, the lock proper (A) assumes its lock cancelling condition causing the open lever 13 to assume its lock releasing position and thus causing the lock condition switch 14 to connect the movable contact with the stationary contact (b). Furthermore, under this condition, the slider 5 is placed at its uppermost position causing the movable contact **28*b* of the switch 28 to connect with the stationary contact (a). The operation switch 35 is kept in a condition wherein the movable contacts 36 and 37 are connected with the stationary contacts (a) and (a). Accordingly, in this condition, there is established a so-called "short circuit" which includes the positive terminal of the battery, the timer "T", the stationary contact (a) for the movable contact 37 of the operation switch 35, the movable contact 37, the stationary contact (a) of the switch 28, the motor 31, the breaker "B", the movable contact of the locked condition switch 14, the stationary contact (b) of the same and the positive terminal of the battery. Thus, the motor 31** is deenergized.

When now the trunk lid 1 is lowered to its half-closed position as shown in FIGS. 2, 4, 5 and 8, the striker 3 enters the cut **7*b* (see FIG. 4) of the slider 5 and the catching recess 8*a* of the latch plate 8. When the lid 1 is further lowered, the striker 3 is brought into full engagement with the latch plate 8**.

With this movement, the pawl plate 9 and the open lever 13 are rotated to their lock establishing positions due to the force of the spring 12, so that due to the movement of the open lever 13, the locked condition sensing switch 14 moves the movable contact from the stationary contact (b) to the other stationary contact (a) as illustrated by a broken line in FIG. 15.

With this movement, a so-called "slider lowering circuit" is established which comprises the positive terminal of the battery, the timer "T", the stationary contact (a) for the movable contact 37 of the operation switch 35, the movable contact 37, the stationary contact (a) of the switch 28, the motor 31, the breaker "B", the movable contact of the locked condition sensing switch 14, the stationary contact (a) of the same, the movable contact 36 of the operation switch 35, the stationary contact (a) of the same and the negative terminal of the battery. Thus, the motor 31 is energized to rotate the output shaft 31*a* in a normal direction causing the slider 5 to move from the uppermost position toward the lowermost position.

When the slider 5 comes to the lowermost position having the trunk lid 1 settled in the full-closed position, the actuating lever 28*a* of the switch 28 is pushed upward by the lower stopper 30, so that the movable contact 28*b* of the same is shifted to the other stationary contact (b) as is illustrated by a broken line in FIG. 15. Because of disengagement of the movable contact 28*b* from the stationary contact (a), the "slider lowering circuit" is opened thereby stopping operation of the motor 31. Under this condition, the trunk lid 1 is fully closed and locked.

When thereafter the operation switch 35 is manually closed by a person in the vehicle cabin, a so-called "slider elevating circuit" is established which comprises the positive terminal of the battery, the timer "T", the stationary contact (b) for the movable contact 36 of the operation switch 35, the movable contact 36, the stationary contact (a) of the locked condition switch 14, the breaker "B", the motor 31, the movable contact 28*b* of the switch 28, the stationary contact (b) and the negative terminal of the battery. Thus, the motor 31 is energized to rotate the output shaft 31*a* in the reversed direction causing the slider 5 to move upwardly from the lowermost position toward the uppermost position.

During this upward movement of the slider 5, the locked condition of the lock proper (A) is cancelled by the function of the lock cancelling mechanism (B) as has been described hereinabove. Thus, the latch plate 8 is turned by the associated spring (not shown) to the striker releasing position releasing the striker 3 from the lock proper (A).

During this movement, the open lever 13 is pivoted from its lock establishing position to its lock releasing position, so that the locked condition sensing switch 14 moves the movable contact from the stationary contact (a) to the other stationary contact (b). With this, a so-called "slider elevation assuring circuit" is established which comprises the positive terminal of the battery, the timer T, the stationary contact (b) of the locked condition switch 14, the breaker "B", the motor 31, the stationary contact (b) of the switch 28 and the negative terminal of the battery. Thus, even when, during the upward movement of the slider 5, the operation switch 35 is opened breaking the "slider elevating circuit", the lock proper (A) does not stop its upward movement.

When the slider 5 comes its uppermost position, the actuating lever 28*a* of the switch 28 is pushed down by the upper stopper 29 so that the movable contact 28*b* of the same is shifted to the stationary contact (a). When, thereafter, manipulation of the operation switch 35 is ceased, the movable contacts 36 and 37 of the switch 35 are shifted to the stationary contacts (a) and (a) thereby breaking the "slider elevation assuring circuit" and establishing the "short circuit". With this, the operation of the motor 31 is stopped, and the control circuit returns to its rest condition shown by the solid lines in FIG. 15. Of course, the lock proper (A) returns to its rest condition shown in FIG. 1.

In addition to the above-mentioned electrically controlled operation, the following manual operation is available for opening the trunk lid 1.

That is, when, with the trunk lid 1 being fully closed as shown in FIG. 3, the key cylinder 4 is turned in a given direction by a key plate (not shown) manipulated by a person from the outside of the vehicle body, the rods 27 and 24 are pulled toward the key cylinder 4 turning the open lever 13 to its lock releasing position. With this, the locked condition of the lock proper (A) is cancelled causing the striker 3 of the lid 1 to disengage from the lock proper (A), so that the trunk lid 1 is opened. Because of the reasons which have been described hereinabove, turning the open lever 13 to its lock releasing position causes the movable contact of the locked condition sensing switch 14 to be shifted to the stationary contact (b). With this, the above-mentioned "slider elevation assuring circuit" is established, so that the motor 31 is energized to rotate the output shaft 31*a* in a reversed direction moving the slider 5 upward.

During this upward movement of the slider 5, the lock cancelling lever 15 and the connecting lever 19 are moved toward the open lever 13. However, since the open lever 13 has been kept in its lock releasing position, the "slider elevation assuring circuit" is maintained continuing the upward movement of the slider 5.

When the slider 5 comes to its uppermost position, the actuating lever 28*a* of the switch 28 is pushed down by the upper stopper 29 so that the movable contact 28*b* of the switch 28 is shifted to the stationary contact (a). Thus, the "slider elevation assuring circuit" becomes opened thereby stopping the motor 31 and thus stopping the slider 5 at its uppermost position.

In the following, description of the operation will be directed to a case wherein for some reason, the downward movement of the slider 5 is discontinued. This case would occur when, during closing movement of the trunk lid 1, a foreign thing gets in the way of the lid 1 under closing. In fact, upon this, a safety device (not shown) senses overload of the motor 31 and stops the same. This case also occurs when due to the provision of the foreign thing, the full closing of the trunk lid 1 is not accomplished within a period determined by the timer "T". Of course, vehicle collision may cause such stop.

In such case, the operation switch 35 is manipulated to shift the movable contacts 36 and 37 to the stationary contacts (b) and (b). With this, the slider 5 can be moved upward for the reasons which will be described in the following.

That is, under such undesired condition, the movable contact 28*b* of the switch 28 is kept connected with the stationary contact (a) since the slider 5 fails to reach its lowermost position. When now the movable contacts 36 and 37 of the operation switch 35 are shifted to the stationary contacts (b) and (b), a so-called "emergency elevation circuit" is established which comprises the positive terminal of the battery, the timer "T", the stationary contact (b) for the movable contact 36 of the operation switch 35, the stationary contact (a) of the locked condition sensing switch 14, the breaker, the motor 31, the stationary contact (a) of the switch 28, the movable contact 37 of the operation switch 35, the stationary contact (b) of the same, and the negative terminal of the battery. Thus, the motor 31 is energized to rotate the output shaft 31*a* in a reversed direction thereby moving the slider 5 upward to its uppermost position. It is to be noted that during this upward movement, the movable contact 28*b* of the switch 28 is kept connected with the stationary contact (a).

When the slider 5 comes to its uppermost position, the operator releases his hand from the operation switch 35 causing the movable contacts 36 and 37 to be shifted to the stationary contacts (a) and (a). With this, the control circuit returns to its rest condition as shown by solid lines in FIG. 15. Under this rest condition, the foreign thing is removed and/or the device is repaired. Thereafter, the trunk lid closing operation is carried out again.

As is understood from the foregoing description, the present invention brings about the following advantages:

First, since the striker which is relatively light in weight is mounted to the trunk lid, the opening movement of the lid is easily achieved.

Second, since lock proper which is bulky in construction is not mounted to the trunk lid, loading and unloading of luggages into and from the trunk are smoothly carried out.

Third, since the electric parts are all mounted to a device connected to the vehicle body, wiring of them is simplified.

What is claimed is:

1. An electric locking device for locking a lid to a receptacle member, comprising:

a striker mounted to said lid;

a lock proper mounted to said receptacle member and locking said striker when the striker is brought into full engagement therewith, said lock proper being movable relative to said receptacle member along a guide path;

a locked condition sensing means mounted to said receptacle member, said sensing means issuing a striker locked condition representing signal when said striker is locked by said lock proper and issuing a striker released condition representing signal when said striker is released from said lock proper;

an electric mover mounted to said receptacle member for moving, when electrically energized, said lock proper along said given way;

a control circuit for controlling operation of said electric mover in such a manner that when said sensing means issues said striker locked condition representing signal, the mover moves said lock proper in one direction along said guide path to a first position for achieving full closing of said lid and when said sensing means issues said striker released condition representing signal, the mover moves said lock proper in a second direction along said guide path to a second position for catching said striker; and a hollow slider to which said lock proper is installed, and a guide frame to which said slider is slidably connected, said guide frame being secured to said receptacle member;

wherein said lock proper comprises:

a latch plate rotatably held in said slider;

a pawl plate rotatably held in said slider, said pawl locking said latch plate when the latter latches said striker;

an open lever rotatable together with said pawl plate;

a lock cancelling lever pivotally connected at one end to said slider;

a connecting lever connecting said lock cancelling lever to said open lever in a lost motion manner, so that pivoting said lock cancelling lever in a given direction can induce a pivoting of said open lever in a first direction causing said pawl plate to release the latch plate; and actuating means for pivoting said lock cancelling lever in said given direction when said lock proper is moved in said second direction.

2. An electric locking device as claimed in claim 1, in which said locked condition sensing means is mounted to said slider and said electric mover is mounted to a block secured to said guide frame.

3. An electric locking device as claimed in claim 1, further comprising first biasing means for biasing said open lever to pivot in a direction opposite to said first direction, and second biasing means for biasing said lock cancelling lever to pivot in a direction opposite to said given direction.

4. An electric locking device as claimed in claim 3, in which said actuating means comprises:

a member secured to said guide frame and having an inclined surface formed thereon; and a projection formed on said lock cancelling lever, wherein under movement of said lock proper in said the other direction, said projection being brought into contact with said inclined surface of said member thereby turning said lock cancelling lever in said given direction.

5. An electric locking device as claimed in claim 4, in which said inclined surface of said member and said projection of said lock cancelling lever are so constructed that under movement of said lock proper in said first direction, the engagement between said inclined surface and said projection fails to induce the turning of said lock cancelling lever in said given direction.

6. An electric locking device as claimed in claim 5, in which said locked condition sensing means comprises an ON-OFF switch which operates in response to the pivotal movement of said open lever.

7. An electric locking device as claimed in claim 6, in which said locked condition sensing means further comprises:

a bent portion formed on an end of said open lever; and an actuating arm extending from said ON-OFF switch and slidably engageable with said bent portion, wherein sliding movement of said bent portion on said actuating arm brings about a pivotal movement of said actuating arm thereby to allow the switch to selectively assume ON and OFF conditions.

8. An electric locking device as claimed in claim 7, in which the lost-motion connection between said open lever and said connecting lever is made by:

a pin fixed to said open lever;

an elongate slot formed in said connecting lever and slidably receiving therein said pin.

9. An electric locking device as claimed in claim 8, in which said electric mover comprises:

an electric motor mounted to said guide frame;

a threaded bolt having one end connected to said slider and the other end connected to a drive shaft of said motor through a speed reduction gear, whereby when said motor is energized to rotate said drive shaft, said threaded bolt moves axially thereby to move said slider.

10. An electric locking device as claimed in claim 9, in which said control circuit comprises an ON-OFF switch which changes its state when said lock proper is moved in said one direction along said guide path to said first position and when said lock proper is moved in said second direction along said guide path to said second position.

11. An electric locking device as claimed in claim 10, in which said control circuit further comprises an operation switch which is manually operated.

12. An electric locking device as claimed in claim 11, in which said control circuit further comprises a pilot lamp and a timer, said timer cutting electric supply to said electric motor when a predetermined time passes from the time when energization of said electric motor begins.

13. An electric locking device as claimed in claim 1, further comprising a manually opening mechanism which has a rod pivotally connected to said open lever.

14. An electric locking device as claimed in claim 10, in which said ON-OFF switch comprises a switch proper connected to said slider to move therewith and having an actuating lever, and two spaced stoppers which are connected to said guide frame, said two stoppers being arranged to put therebetween said actuating lever of said ON-OFF switch.

15. An electric locking device as claimed in claim 1, in which said hollow slider is constructed of plastics and sandwiched by metal plates.

16. An electric locking device as claimed in claim 1, in which lock proper further comprises stoppers by which said open lever and said lock cancelling lever are prevented from making excessive pivotal movements.

17. An electric locking device as claimed in claim 10, in which the locked condition sensing switch and the switch proper of said ON-OFF switch are both mounted on a common bracket which is secured to said slider.

* * * * *